United States Patent [19]

Friedson et al.

[11] Patent Number: 4,513,735

[45] Date of Patent: Apr. 30, 1985

[54] APPARATUS FOR TREATING THE FEET

[75] Inventors: Belvin F. Friedson, Miami; Arnold Thaler, Plantation; Ivan Saud, Miami, all of Fla.

[73] Assignee: Windmere Corporation, Hialeah, Fla.

[21] Appl. No.: 549,726

[22] Filed: Nov. 8, 1983

Related U.S. Application Data

[62] Division of Ser. No. 335,360, Dec. 29, 1981, Pat. No. 4,429,687.

[51] Int. Cl.[3] ..... A61H 21/00

[52] U.S. Cl. ..... 128/24.2; 128/32; 128/65

[58] Field of Search ..... 128/24.1, 24.2, 65, 128/66, 62 R, 38, 39, 40, 41, 25 B, 33; 219/310–312, 436, 438; 4/622, 554, 545

[56] References Cited

U.S. PATENT DOCUMENTS

| | | | |
|---|---|---|---|
| 1,556,930 | 7/1924 | Grau | 219/459 |
| 2,546,983 | 4/1956 | Buttero | 219/436 |
| 2,840,071 | 6/1958 | McNair | 128/33 |
| 3,055,357 | 11/1959 | Redka | 128/65 |
| 3,707,961 | 1/1973 | Duplessis | 128/33 |
| 3,965,495 | 6/1976 | McNair | 128/66 X |
| 4,057,053 | 11/1977 | Kunz | 128/25 B |
| 4,315,139 | 2/1982 | Onishi et al. | 219/438 X |

*Primary Examiner*—Richard J. Apley
*Assistant Examiner*—David J. Brown
*Attorney, Agent, or Firm*—Gary M. Hoffman

[57] ABSTRACT

A portable, compact foot treatment unit to be used either with or without water and capable of providing various combinations of heat and massage is disclosed. The unit includes a casing having a tub for receiving a liquid. Heat is provided both at the water line level and also below the foot rests to achieve a uniform temperature throughout the water bath. Other features that can be included are an improved vibrator assembly and foot rests having raised arch portions with anatomically designed features. The vibrator includes a C-shaped vibrator plate and a power transformer mounted at the upper end portion of the plate. The lower end portion of the plate is mounted in the casing at the level of the floor of the casing. The floor of the casing has a foot receiving section that has a specially formed anatomically shaped arch construction.

6 Claims, 6 Drawing Figures

APPARATUS FOR TREATING THE FEET

This is a division of application Ser. No. 335,360, filed Dec. 29, 1981, now U.S. Pat. No. 4,429,687.

BACKGROUND OF THE INVENTION

The present invention relates to apparatus for providing massage and heat to the feet. More particularly, the present invention relates to a portable foot treatment unit capable of providing various combinations of massage and heat for the feet, and with the special feature of providing comfortable, uniformly warm temperatures when used either with or without water.

In the prior art there are various known foot care massages and baths which are capable of providing either a vibrating massage alone, a vibrating massage with dry heat or a vibrating massage with a liquid bath and a supplemental heater. In the latter category, there has been a need for a foot massage unit which will provide a comforting and refreshing water massage with uniformly warm water temperatures for the feet.

Exemplary of such foot care massage and bath devices are those units disclosed in U.S. Pat. Nos. 2,904,037 to Cassidy; 3,830,232 to McNair; 3,881,471 to Grube; 3,942,520 to McNair; 3,965,495 to McNair; and, 4,057,053 to Kunz. Such devices, however, normally provide heaters for only limited heating of the liquid and fail to provide uniform heating of the liquid within the tub. These heaters of such units also are generally incapable of enabling the units to be used for either a wet or dry heat treatment of the feet. In addition the floor support construction of these devices are deficient in providing full and proper support for the feet of the user.

SUMMARY OF THE INVENTION

In developing the feet care system of the present invention, the primary objective was to provide an improved unit capable of overcoming the above-mentioned deficiencies in the prior art units. The objectives of concern are more fully set forth below.

In accordance with the present invention there is provided a portable, compact foot treatment unit which may be used for massage only or for the application of heat only or, alternatively, for the application of both heat and massage to the feet. The present unit includes a comfort control panel having low and high settings for combinations of both heat and massage. Heat is provided both at the water line level and also below the foot rests to achieve a uniform temperature throughout the water bath.

The foot treatment unit of the present invention also can further include an improved vibrator assembly that provides even distribution of massage action to the feet. The foot rests within the casing of this unit are provided with raised arches having anatomically designed features which allow any of various foot shapes to be accommodated. A further feature of the present apparatus includes the use of an arrangement of stimu-nodes in the surface of the foot rests for the application of heat and massage to the lower portions of the feet.

The anatomically designed foot rests are provided with raised, curved arches which cradle the feet, making contact with every part of the soles for a complete overall massage. Thus by simply moving the feet to the point where the arches fit over the raised arch construction of the foot rests, a correct and comfortable contact is provided, whether the arches of the user are high, medium or low. The small stimu-nodes located in the foot rests act as gentle fingers to make contact with the soles of the feet, thus providing an effective and invigorating massage. The action of the stimu-nodes can be controlled by pressing down lightly or letting up the pressure on the lower surfaces of the feet. In the operation of the unit, the stimu-nodes allow water and heat in combination to flow under the feet for better circulation.

Located under the foot rests are full length heating members which are current controlled to maintain the desired temperature throughout the massage, with or without water, when the controls are set at either the heat or heat/massage position. Thus the present invention is an improvement over previous foot massage units containing a heat plate which requires water as the heat transfer medium and which cannot be alternatively used in a dry condition.

A particular feature of the foot bath massager of the present invention includes the use of a deep upper casing in which heating means is provided at the upper level of the water table. The location of a heating element near the top of the unit causes the surface water to heat quickly and set up a warm zone at the surface which counteracts the tendency of the surface water to become cool as heat is lost to the surrounding air. The heating elements which are located under the foot impressions heat at approximately the same rate as the upper element. This arrangement provides heat from both above and below to warm the cool water which is located between the upper and lower elements. Thus there is accomplished a unique feature, in that the user of the massage bath may simply add tap water and the unit will provide the heat necessary to increase the temperature to approximately 40° C. Then as long as the heat control switch is actuated to the high position, the unit will maintain this temperature indefinitely within very small tolerances depending upon ambient conditions. The particular construction of the present invention also provides the feature of maintaining comfortable warm temperatures of approximately 40° C. When used with water, while still maintaining a comfortable average surface contact temperature, when used in a dry condition, of about 35° C. in the low heat position and 50° C. in the high heat position. After extensive analysis, it has been found that the optimum temperature range is 30° C. to 55° C. for achieving maximum comfort.

The source of vibration in the foot treatment unit of the present invention includes a combination of a power transformer and a metal plate, utilizing the make and break magnetic field as a source of vibration, rather than a conventional motorized counterweight. The transformer is mounted in a centerline position to provide improved distribution of the vibration effect. In addition, the rib which extends longitudinally between the foot inserts is positioned so as to assist in distributing the vibration effect more evenly and to concentrate the vibration in the high arch area. The foot treatment unit of the present invention is compact in size, requiring only small amounts of water when used as a foot bath, and is easy to store, thus providing a unit which is highly portable.

It is accordingly one object of the present invention to provide a foot treatment unit including improved means for uniformly heating the feet, whether the unit is employed with or without liquid.

In conjunction with the preceding object, it is another object of the invention to maintain a comfortable temperature range during the application of heat to the feet of the user.

It is another object of the invention to provide a foot massage unit having an improved vibrator assembly for generating the massage action.

A further object of the invention is to provide a foot treatment unit in which the foot rests have anatomically constructed features which will accommodate any of various foot shapes.

A still further object of the invention is to provide a foot treatment unit which is highly compact and portable, and which may be used for massage only, or for heat only, or for application of both heat and massage, at any of various levels of intensity.

BRIEF DESCRIPTION OF THE DRAWINGS

The advantages and features of the foot massager of the present invention will be more fully understood from the following description of the preferred embodiments, taken in conjunction with the accompanying drawings, wherein.

DESCRIPTION OF THE PREFERRED EMBODIMENTS

Figure 1:
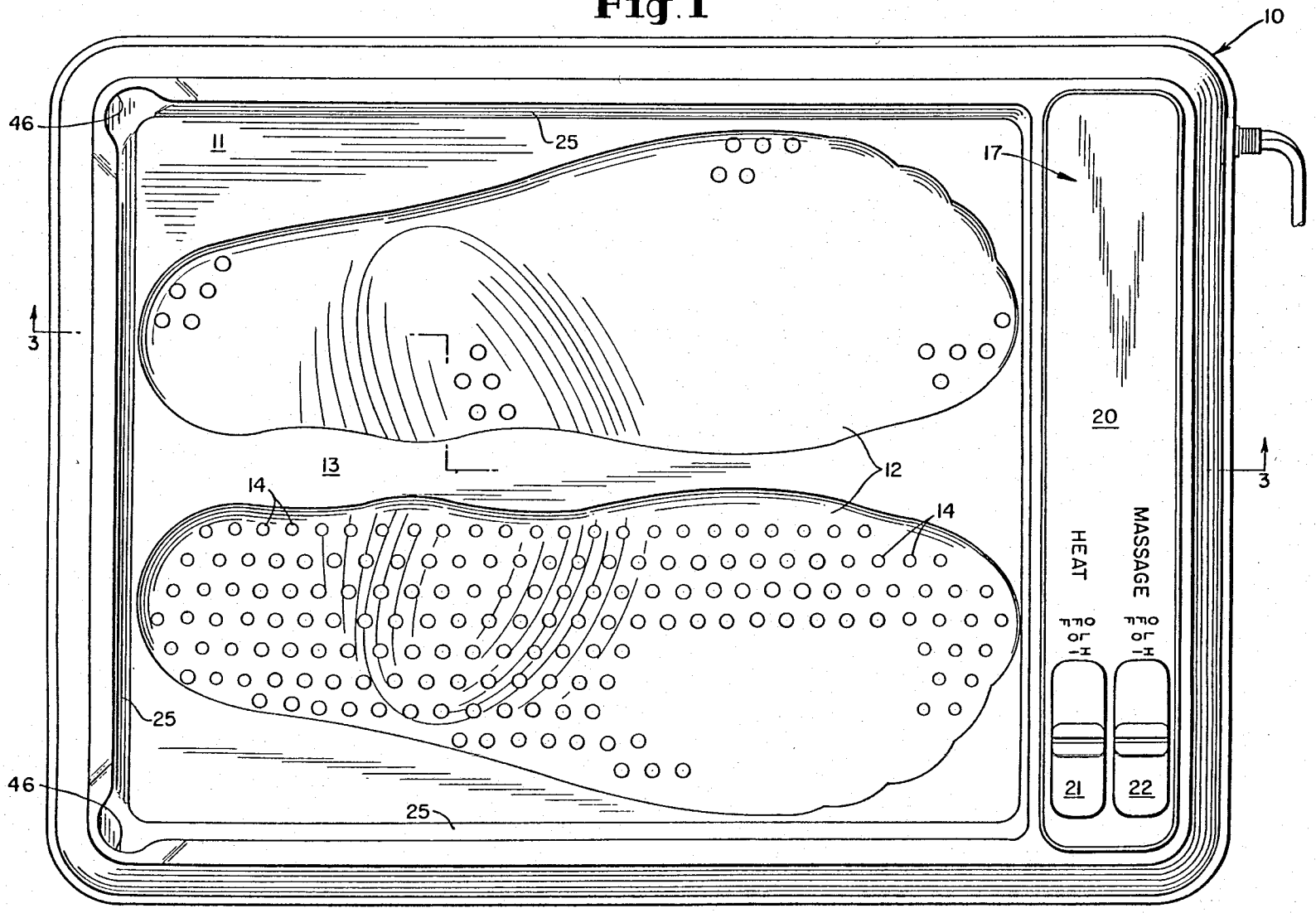
FIG. 1 is a top plan view of the foot massager of the present invention.
Figure 2:
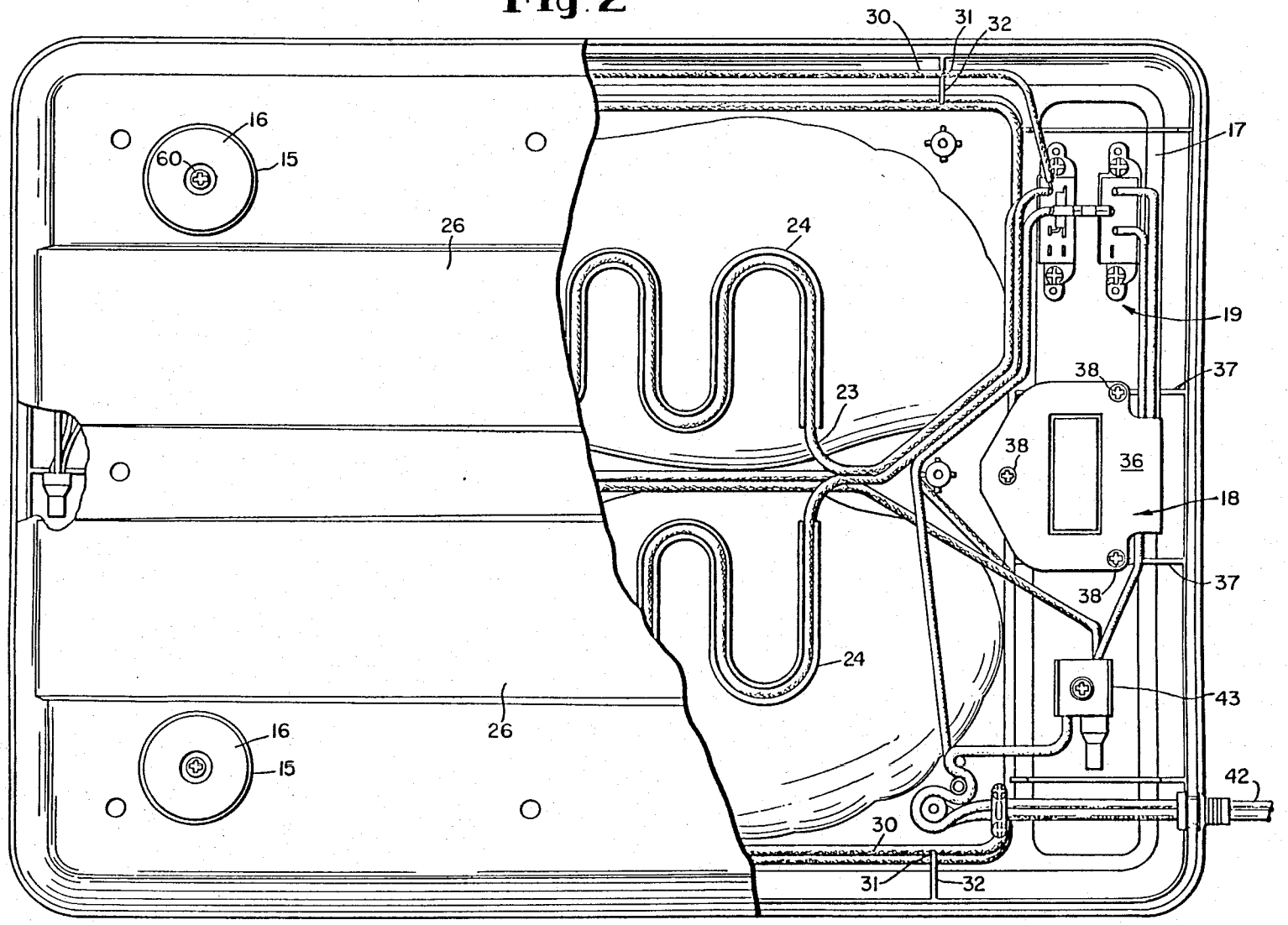
FIG. 2 is a bottom plan view, partly cut away, of the foot massager of FIG. 1.
Figure 3:
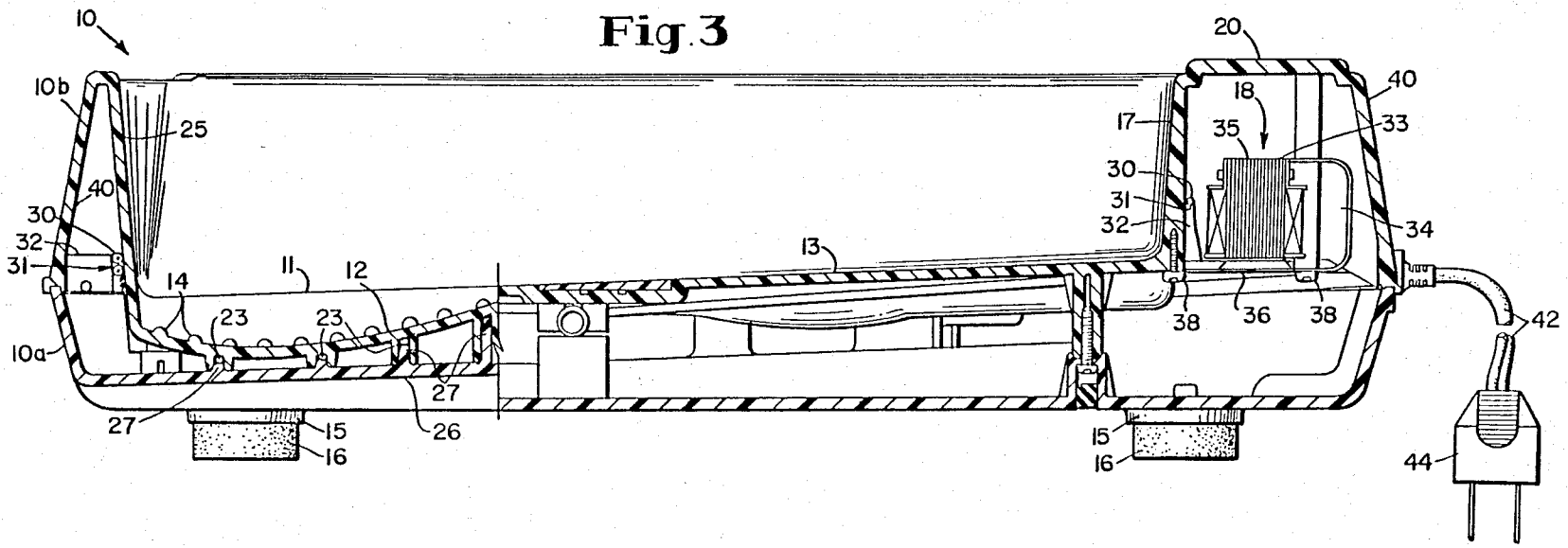
FIG. 3 is a side elevation in cross-section, taken along line 3—3 of FIG. 1.

In the embodiment of the present invention as shown in FIGS. 1-5, there is provided a foot massage unit which includes a casing 10 having a lower portion **10*a* and an upper portion 10*b*. The casing is preferably made of a high grade molding plastic and portions 10*a* and 10*b* are connected by suitable sealing means. As shown in FIG. 3, the upper casing 10*b* has upstanding interior side walls 25 which terminate at their lower ends in a floor 11, thus providing a generally rectangular tub for containing liquid. A pair of foot receiving stations 12 are indented into floor 11, providing a ridge 13 between stations 12 which extends the length of floor 11. Stations 12** are shaped generally according to the contour of the human foot and are spaced apart sufficiently to allow the user to place the feet thereon in a comfortable position.

The surfaces of the foot receiving stations 12 are provided with a plurality of protruberances or stimu-nodes 14 which are slightly raised above the surface of the stations 12. In one embodiment, these stimu-nodes 14 are uniformly positioned in longitudinally extending parallel rows, with the distance between successive stimu-nodes 14 in each row being approximately $\frac{3}{8}$ inch from center to center and with an interval of approximately $\frac{3}{8}$ inch between rows. Preferably, the stimu-nodes 14 of a given row will be staggered relative to those of the adjacent row, so that any particular stimu-node 14 will be located approximately opposite the midpoint of a line between the adjacent stimu-node 14 in the next row. The stimu-nodes 14 are generally dome-shaped and protrude upwardly approximately 1/12 inch (2 millimeters) above the main surface of the foot stations 12. While some nodules have occasionally been used in prior art units these only have a height of 1 mm which does not provide for the optimum benefits achieved by the employment of the stimu-nodes 14 of the present invention.

Figure 5:
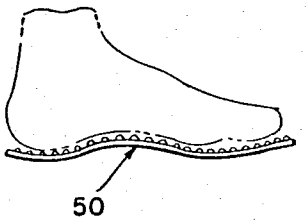
FIG. 5 is a cross-sectional view showing the foot rest surface of one of the foot inserts of the present foot massager, with the foot of a user of the device shown in phantom lines.

As shown in FIG. 5, the foot receiving stations 12 are each provided with a raised curved arched portion 50 which is anatomically constructed so as to cradle the foot. Such arched portions 50 are sufficiently raised along the inner surface thereof as to accommodate the higher arch constructions, while having a lower raised portion toward the outer surface which will accomodate the lower arch constructions. Thus, as the foot receiving stations 12 are larger than the feet of most persons, by moving the feet across the surface of the stations 12, a position can be found which will provide a correct and comfortable contact with the surfaces of the stations 12 throughout the entire area of the soles of the feet.

The casing 10 is supported on four short legs 15 which extend below floor 11 near the four corners thereof. Each leg 15 has a pad 16 on its lower end, with the pad 16 being attached to the leg 15 by suitable securing means 60. Drain spouts 46 are provided in the upper end of the walls 25 for convenience in pouring off water after the water bath has been completed.

The upper casing portion **10*b* terminates at its forward end in a compartment 17 which projects upwardly from floor 11 to a height equal to that of the side walls of casing 10*b*. Compartment 17 is of substantially uniform size across the forward part of the casing 10 and provides a housing for the vibrator motor assembly 18 and the unit control switch assembly 19, to be described hereinafter. The upper surface 20 of compartment 17 is substantially flat and provides a mounting surface for the heat 21 and massage 22 control switches of assembly 19**.

Heating of the present foot massage unit is accomplished by means of heating units located both in the area directly beneath floor 11 and also around the upper interior side walls 25 of casing portion **10*b*. As shown in FIG. 2, the heating means located under floor 11 includes a rope heating element 23 secured within channels 24 which wind back and forth in a series of U-shaped or serpentine curves, with channels 24 being formed into the lower surface of floor 11 directly beneath foot receiving stations 12. As shown in FIG. 3, lower casing portion 10*a* has a raised interior floor portion 26 directly beneath each of the foot stations 12, with a plurality of raised stud members 27 located in the floor portions 26 for engagement with the channels 24 to lock the rope heating element 23 in position directly adjacent the floor 11. The rope heating element 23 winds back and forth across the width of each foot receiving station 12 and extends from the heel area to the area corresponding to the position at which the toes of the average user would be located, thus providing coverage over substantially the entire lower surface of each foot station 12**.

The heating means for the side walls 25 includes a rope heating element 30 which extends around the entire periphery of upper casing portion **10*b*, as shown in FIGS. 2 and 3. The rope heating element 30 is secured to the side walls 25 at a distance above the floor 11** corresponding to the upper level to which liquid is received in the tub, by mean such as notches 31 formed in brackets 32 which extend between side walls 25 and the exterior walls 40 of casing portion 10*b*. The brackets 32 are located at intervals around the exterior of the side walls 25 with the notches 31 thereof receiving the rope element 30 to maintain it in position. Both rope heating elements 23 and 30 are electrically connected to switch assembly 19 for control by heat control switch 21.

The rope heating elements 23 and 30 may be of any suitable heat conductive materials which are conventional in the art to which the invention pertains, of a size generally about $\frac{1}{8}$ to $\frac{3}{8}$ inch in diameter. Such heat conductive elements 23 and 30 should be capable of transmitting heat to the body of the casing 10, with such heat being limited sufficiently so that the temperatures generated do not exceed the melting point of the plastic casing 10. Generally, the total wattage for the elements 23, 30 should be about 40 to 50 W at low heat and about 55 to 70 W at high heat.

The channels 24 and notches 31 within which the rope elements 23, 30 are installed on the casing 10 serve to distribute the heat without the necessity for the use of a metal plate. In this regard, a minimum plastic thickness of about 0.78 mm with 2.5 to 3.2 mm being the optimum thickness for the casing 10 has been found to be desirable in order to provide proper heat distribution. In one embodiment, the particular plastic employed for the casing was polypropylene.

Mounted in the center portion of compartment 17 in alignment with the longitudinal axis of the casing 10 is a vibrator motor assembly 18, including a power transformer 33 secured at its upper end to a C-shaped metal vibrator plate 34. The vibrator plate 34 has an upper surface 35 which is secured in coplanar relation to the top of the transformer 33, and with the lower end 36 of the plate 34 being mounted on the casing 10*b* at the level of the floor 11 by suitable securing means 38, employing brackets 37 which extend across the compartment 17. In one embodiment the upper end 35 of plate 34 has a width of above $1\frac{1}{2}$ inches, and with the lower end 36 of plate 34 extending to an overall width of about $2\frac{1}{2}$ inches. The transformer 33 is electrically connected to switch assembly 19 for control by massage control switch 22.

Figure 4:
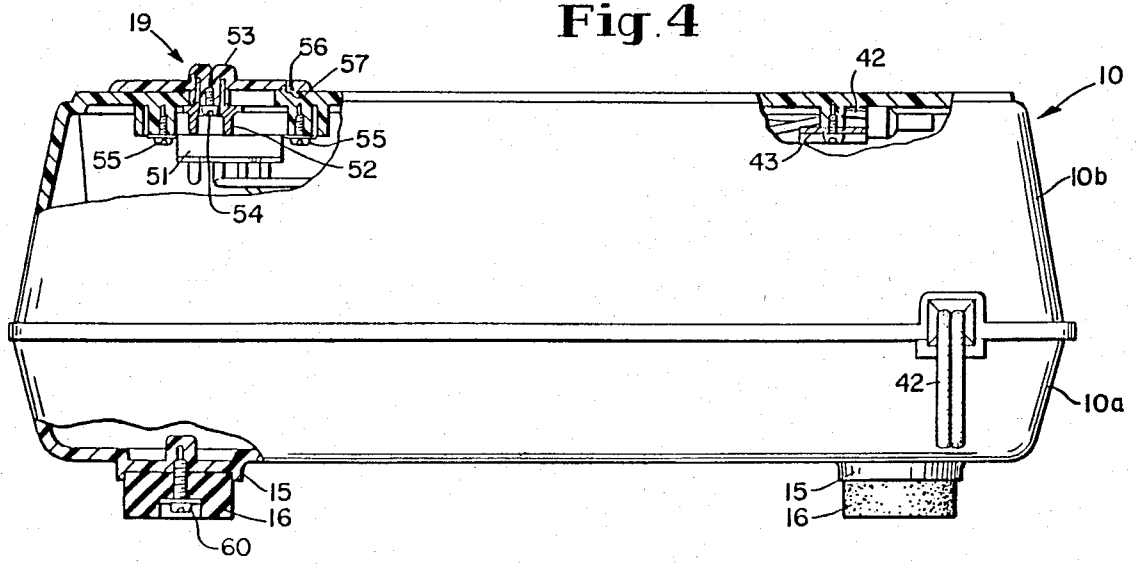
FIG. 4 is an end view of the foot massager of FIG. 1.

The wiring for the unit includes a lead-in wire 42 which enters the casing 10 from the rear, as shown in FIG. 4, and is provided with a plug 44 on its end for connection to a wall outlet. The wiring extends within the hollow interior of the casing 10, being secured to the casing 10 at various points by suitable securing means 43, to interconnect switch assembly 19 with rope heating elements 23, 30 and vibrator assembly 18 such that the switch assembly 19 can be set to operate the heating element and vibrator assembly either alone or together. Accordingly, the assembly 19 includes a heat control switch 21 and a massage or vibrator switch 22, each having an off position as well as high and low settings.

The switch assembly 19 includes a conventional slide switch 51, as shown in FIG. 4, with integral switch cap holder 52 which is interfitted with and secured to switch cap 53 by screw means 54. The switch 51 is attached to the casing 10 by suitable securing means 55. An O-ring 56, of neoprene rubber or other suitable material, is located between the switch cap 53 and the casing 10, with the O-ring 56 being positioned in a circular notch 57 formed in the upper surface of the casing 10. In this manner there is obtained a sealing, fluid-tight engagement between the switch cap 53 and the casing 10, thus providing a waterproof construction for the switch assembly 19.

Figure 6:
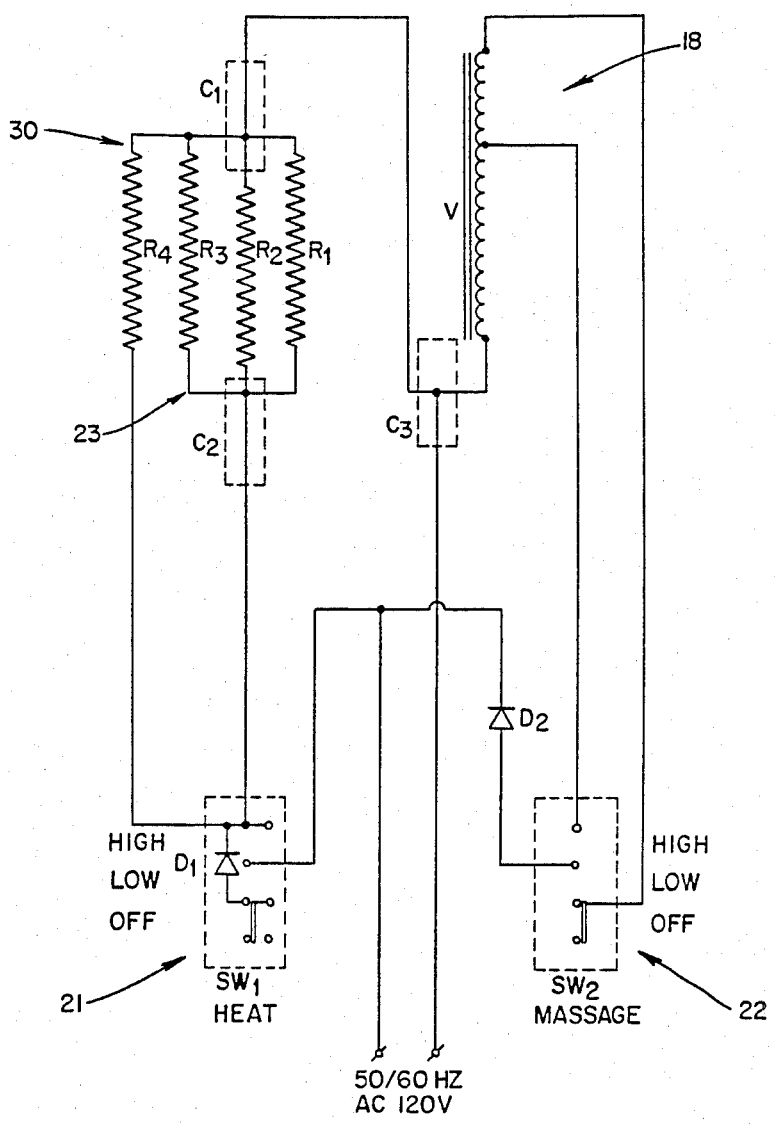
FIG. 6 is a wiring diagram showing the interconnection of various components of the foot massager of FIG. 1.

In FIG. 6 there is provided a wiring diagram showing the interconnection of the switch assembly 19 with the heating elements 23, 30 and the vibrator assembly 18. Thus slide switch $SW_1$ represents the heat control switch 21 while slide switch $SW_2$ represents the vibrator control switch 22. Resistors $R_1$ and $R_2$ represent lower rope heating element 23 while resistors $R_3$ and $R_4$ represent upper rope heating element 30. The vibrator assembly 18 is designated as "V" in FIG. 6; C, $C_2$ and $C_3$ are closed end connectors and $D_1$ and $D_2$ are diodes employed with the respective heating and vibrator circuits. As can be seen in FIG. 6, the actuation of heat switch $SW_1$ will energize both rope heating elements 23, 30 in either the high or low setting, thus providing heat both below the foot receiving stations 12 and around the side walls 25. Similarly, the actuation of vibrator switch $SW_2$ in the high or low setting will energize the power transformer 33 such that, with the 60 cycle AC current normally supplied, there is set up a make and break magnetic field in conjunction with the metal plate 34, thus causing the plate 34 to vibrate. This vibration is transmitted to the casing 10, causing the casing 10 and particularly the floor 11 to vibrate in a vigorous manner. Such vibration effects are transmitted uniformly throughout the unit due to the location of the vibrator assembly 18 along the longitudinal axis of the casing 10 and with the plate 34 of the vibrator assembly 18 secured to the casing 10 at the level of the floor 11.

From the foregoing it will be seen that the present invention is well adapted to attain all the objectives set forth above, together with additional advantages which are inherent in the structure.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

It is claimed:

1. Apparatus for providing a heated massage treatment for the feet, said apparatus comprising: a casing including a tub for receiving and containing liquid for encircling the feet in such liquid, said tub having a floor with upwardly extending side walls; a foot receiving station located in said floor; and first and second heating means for providing heat to liquid within said tub for heating such liquid and maintaining the temperature of such liquid relatively uniform from top to bottom of the liquid and for providing heat directly to said foot receiving station; said first heating means being located below and adjacent to said floor, said first heating means including a rope heating element which is mounted in a channel located in the lower surface of the floor beneath each of the foot receiving stations, said rope heating elements extending the length and width of said foot receiving stations in a series of U-shaped or serpentine curves; said second heating means being mounted within said casing at a distance above the floor corresponding to the approximate upper level to which said tub is to be filled with liquid, said second heating means including a rope heating element mounted in brackets which extend inwardly from the exterior side walls; said casing further including a bottom member having means for locking the rope heating elements in position directly adjacent the floor of the tub; and, vibrator means mounted on the casing for transmitting vibrations to said casing, said vibrator including a C-shaped vibrator plate having upper and lower end portions, a power transformer mounted at the upper end portion of said plate with the lower end portion of said plate being mounted on the casing at the level of the floor, and said vibrator being aligned with the longitudinal axis of said casing.

2. The apparatus according to claim 1 wherein the upper and lower heating means comprise rope heating elements having a total wattage of from about 40 to 70 W.

3. The apparatus according to claim 1 wherein the casing is formed of a plastic material having a minimum thickness of about 0.78 mm with an optimum thickness of 2.5 mm to 3.2 mm.

4. Apparatus according to claim 1 wherein there are two of said feet receiving stations, each of said stations including an anatomically shaped arch construction having an inner surface portion which is sufficiently raised to accommodate higher arch constructions, and with a lower raised portion toward the outer surface of the foot receiving station which will accommodate lower arch constructions so that said floor receiving stations cradle feet of most sizes making contact with every part of the soles for a complete overall massage.

5. The apparatus of claim 4 wherein a plurality of protruberances are provided in the surface of each foot receiving station, said protruberances being uniformly positioned in longitudinally extending parallel rows.

6. The apparatus of claim 5 wherein the distance between successive protruberances in each row is approximately $\frac{3}{8}$ inch from center to center and with an interval of approximately $\frac{3}{8}$ inch between rows, the protruberances being dome-shaped and extending upwardly approximately 1/12 inch above the main surface of the foot receiving stations.

* * * * *